United States Patent [19]

Ahrens et al.

[11] 4,437,509

[45] Mar. 20, 1984

[54] METHOD FOR CONTROL OF BILLET STRIPPING

[75] Inventors: Max Ahrens, Irvine, Calif.; Manfred Haissig, Meerbusch, Fed. Rep. of Germany

[73] Assignee: Boehler Aktiengesellschaft, Dusseldorf, Fed. Rep. of Germany

[21] Appl. No.: 303,787

[22] Filed: Sep. 21, 1981

[30] Foreign Application Priority Data

Oct. 1, 1980 [DE] Fed. Rep. of Germany ..... 3037048

[51] Int. Cl.[3] ..... B22D 11/16

[52] U.S. Cl. ..... 164/454; 164/478; 164/484

[58] Field of Search ..... 164/454, 484, 478, 413, 164/416, 440, 435, 491

[56] References Cited

U.S. PATENT DOCUMENTS 3,575,230 4/1971 Calderon ..... 164/454
3,669,176 6/1972 Krall et al. ..... 164/478
3,726,333 4/1973 Goodrich et al. ..... 164/413 X
3,817,313 6/1974 Gamble et al. ..... 164/478

FOREIGN PATENT DOCUMENTS 2340636 2/1975 Fed. Rep. of Germany .

*Primary Examiner*—Gus T. Hampilos
*Assistant Examiner*—J. Reed Batten, Jr.
*Attorney, Agent, or Firm*—Brumbaugh, Graves, Donohue & Raymond

[57] ABSTRACT

A process for controllng the withdrawal of a casting from a cooled, horizontal, continuous casting mold involves withdrawing the casting from the mold in a series of steps, between which steps the casting is pushed back by a partial step to insure the welding together of casting sections. A melt breakthrough of the casting skin is prevented by measuring the expansion or contraction of a wall of the mold in contact with the casting and controlling the withdrawal of the casting in response thereto.

10 Claims, 4 Drawing Figures

METHOD FOR CONTROL OF BILLET STRIPPING

BACKGROUND OF THE INVENTION

This invention relates to a process for the control of the withdrawal of a casting from a cooled, horizontal, continuous casting mold made from a material of elevated heat conductivity, wherein (a) the casting is withdrawn in steps from the mold, (b) the metallic melt, e.g. steel melt, arrives discontinuously in the mold and, (c) following the formation of the casting skin and each withdrawal step, the casting is pushed back by a partial step.

In the case of horizontal, continuous casting, the casting that is formed with metals having an elevated melting point is withdrawn in steps from a stationary or movable horizontal mold. Between the individual steps there is a stoppage or idling period, or the casting is pushed back by a partial step. This mode of operation is followed in order to bring about a welding of the casting skin that is formed directly from the melt with the casting skin that has already been formed and that has already been withdrawn by one step. If a complete welding does not occur, there exists the danger that the newly formed casting skin will remain at the beginning of the mold and that between it and the casting skin that has already partially solidified, there will exist some liquid melt which, upon a subsequent withdrawal of the casting, might emerge from the mold. If such a so-called "breakthrough" of the casting does occur, the continuous casting process must be interrupted. Apart from the great hazard to operating personnel and equipment such a breakthrough produces, there is also a substantial interruption of production.

To prevent a casting breakthrough there is already known a process for continuous casting in which the temperature is measured at the mold wall directly at the point of entry of the melt into the mold. If the temperature drops by 8°–25° C. below a predetermined temperature, the casting is held stationary until a rise in temperature can again be recorded. While it is true that it is possible with this process to perform a controlled withdrawal of the casting as a function of the formation of the casting skin, the delays between the failure of the casting skin sections to weld and the measurement of the consequent temperature drop are so great that a breakthrough of the melt out of the mold cannot be reliably prevented. The drawback with this process is that the temperature is measured at the wall of the mold, but this temperature is a function of the quantity of heat reaching the measuring point. The quantity of heat that reaches the measuring point, however, is not a result of thermal radiation, but of heat conduction, which requires a substantial amount of time.

Another process for the stepwise withdrawal of the casting from a horizontal continuous casting mold is known from German Patent No. 2,340,636. In that process the withdrawal and the casting stoppage or idling periods are controlled by the torque of a motor. With this control the basic assumption is that an inadequate cooling of the casting skin will cause it to adhere to the wall of the mold, thereby causing a greater resistance to withdrawal. The drawback with this process is that, in the event of an absence of welding of the freshly formed casting skin with the casting skin previously withdrawn, there is not a greater resistance to withdrawal, only a significantly smaller resistance, so that in this case the hazard also exists that the melt may emerge through casting skin.

SUMMARY OF THE INVENTION

It is the object of the present invention to create a process for the control of the withdrawal of a casting from a horizontal continuous casting mold without the abovementioned drawbacks, and which is easy to implement.

The process according to the invention resides essentially in controlling the withdrawal of the casting as a function of the expansion or contraction of the mold wall that is in contact with the casting skin. The expansion or contraction is brought about by forces that, contrary to heat, are transmitted immediately to the mold wall to such an extent that they can be recorded by measuring devices, i.e. a measurable signal is produced at a point in time when there has not yet occurred any change in temperature at the measuring site and before a breakthrough can occur.

In order to permit the earliest possible recording of the approach of a casting breakthrough, the expansion or contraction is measured at that mold wall that is alternately in contact with the metallic melt or the casting skin. The measurement of the expansion or contraction can be performed particularly advantageously in the space traversed by the cooling medium for the selected mold wall because the measurement can be made there simply and at an approximately constant temperature.

It has proven to be advantageous in the case of a permanent contraction or expansion of the inner wall of the mold, i.e. a contraction which is not followed by expansion, and vice versa, within a predetermined range, to push the casting back by less than the length of a step. As a result it is possible to bring about a secure welding of the casting skin that remained in the mold with the previously withdrawn casting, while avoiding damage to the nozzle elements.

BRIEF DESCRIPTION OF THE DRAWINGS

The foregoing and other features of the present invention will be set forth in greater detail in the following description of an illustrative embodiment and with reference to the drawings wherein.

DESCRIPTION OF AN ILLUSTRATIVE EMBODIMENT

Figure 1:
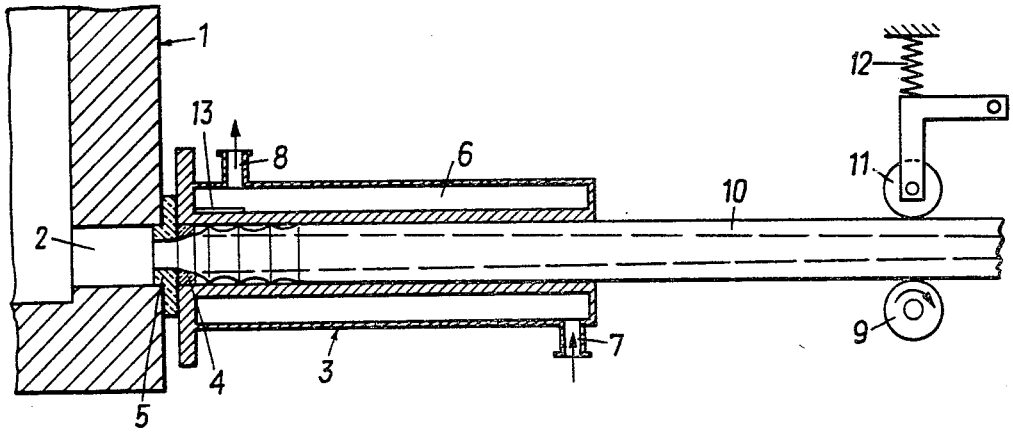
FIG. 1 illustrates a cross section of a horizontal, continuous casting plant in which the mold is provided with an expansion measurement strip.

In the horizontal continuous casting plant illustrated in FIG. 1, the melt container 1 is provided with a duct 2. Between the duct and a mold 3 there is arranged a two-part nozzle element 4, 5 by way of which the melt enters the mold 3 from the melt container. The nozzle element 5 extends with a cylindrical portion into the duct 2 while the nozzle element 4 has a conical inside diameter that leads into the mold cavity. The mold is detachably connected by screws (not shown) with the melt vessel. It has a jacket 6 through which cooling water is passing from an input element 7 to a discharge element 8. Moreover, there is provided a discharge roll 9 that is driven by a motor (not shown in FIG. 1, but indicated schematically as motor M in FIG. 3). The casting 10 is forced by a pivotally-positioned roll 11 and a compression spring 12 against the discharge roll 9.

The casting has, as indicated by dash lines, an external solidified casting skin within which there still exists a liquid melt. The casting skin is formed directly downstream of the nozzle element 4 where, at all times in the course of the withdrawal step, the liquid melt reaches the mold wall, thereby heating and expanding it. At all times during one step of a stepwise withdrawal of the casting, there is formed a casting skin ring with a tapered shape. In this area there is provided an expansion-measurement strip 13 located in the jacket part traversed by the cooling water on the wall of the mold that forms the skin of the casting. This expansion-measurement strip is arranged transverse to the casting withdrawal direction.

This arrangement is particularly advantageous for the formation of small castings and for small step lengths. The expansion measurement strip is soldered or welded to the surface of the wall and is surrounded by an epoxy resin. It is provided with a circuit (not shown) leading to the outside of the mold jacket.

Upon completion of a forwardly oriented withdrawal step, the casting is pushed back by a partial step amounting to about 10% of the forwardly oriented step. As a result, on the one hand, the lengthwise shrinking of the casting caused by its cooling off is balanced out and, on the other hand, there is achieved a pushing or welding together of the casting skin. If a welding-together of the casting skin sections does not occur, one casting skin section will remain in the area where solidification first occurs, whereas the additional casting skin sections are withdrawn with the casting. Consequently, the liquid melt will reach the wall of the mold, even in the area outside of where the casting skin is customarily formed. Therefore, in this area where melt ordinarily does not reach the mold wall, the wall will be expanded by the heat to a greater extent than usual, so that stresses which are usually not present will be measured. In the area in which the casting skin is formed there occurs, however, a further cooling of the casting skin section, thereby bringing about a further contraction of the inside wall of the mold as a result of which there occurs a reduction of the stress.

Figure 2A:
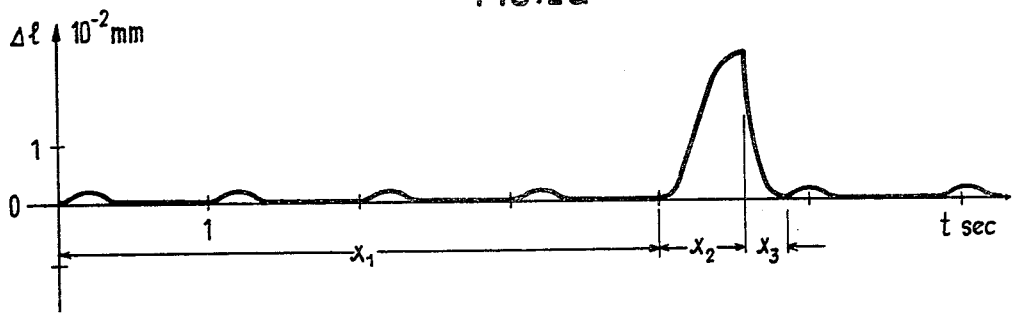
FIGS. 2*a* and 2*b* show two diagrams in which the expansion and contraction is illustrated in a chronological sequence.
Figure 2B:
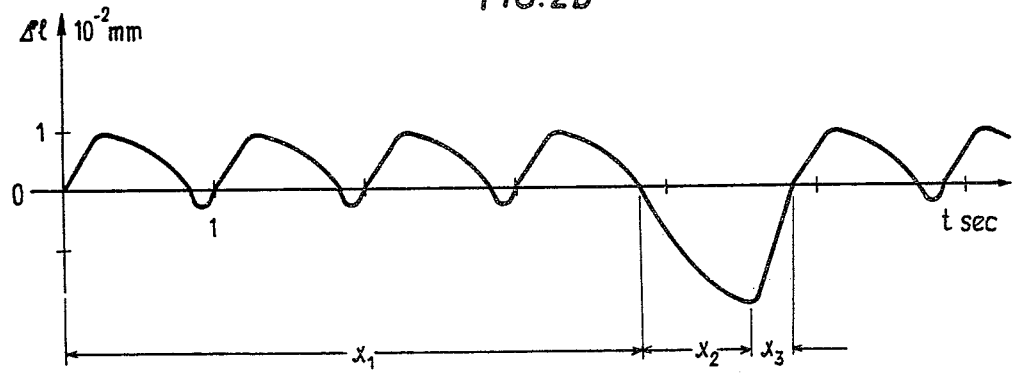

FIGS. 2*a* and 2*b* reproduce the typical curves of stresses versus time as measured by strip 13. For the purpose of an improved representation there is shown, in lieu of the stress, the change in length $\Delta 1$, of the outside of the wall of the mold. The diagram of FIG. 2*a* relates to a measurement result obtained when the expansion measurement strip, or a pressure-sensitive quartz crystal, is arranged in an area in which, during trouble-free continuous casting, no melt reaches the inner wall. Such a trouble-free operation is shown in the region $x_1$. The withdrawal steps each take one second, during which there occurs a slight change in the expansion of the wall corresponding to the taper in the respective casting skin section. This expansion for each withdrawal step is illustrated in the $x_1$ region by the respective maximum values. The zone $x_2$ is significant with regard to an incipient casting breakthrough in the course of which the liquid melt reaches the inner wall of the mold, thereby bringing about a greater expansion thereof. When this occurs the signal from the expansion measuring strip is used as an indication that the casting as a whole is to be pushed back until there occurs a welding of the casting skin section that remained in the mold with the balance of the casting skin. Such a pushing-back is represented in zone $x_3$. Following welding of the casting skin sections the withdrawal of the casting in the customary manner is resumed.

In the diagram illustrated in FIG. 2*b*, the tension states at the outer wall of the mold are illustrated as an indication of the change in the length of the area of formation of the casting skin. The zone $x_1$ relates to a trouble-free withdrawal of the casting where, upon withdrawal of the newly formed casting skin section, hot melt reaches the mold wall thereby causing tension at the outer wall, which tension is reduced continuously through simultaneous cooling of the wall. Then the casting is moved back by about 1/10th of the step so that the change in tension through the arbitrarily determined zero point moves into the negative zone. The casting is then withdrawn again immediately thereafter, whereupon liquid melt once again reaches the wall of the mold. If, however, the newly formed casting skin section remains in the mold and is not withdrawn together with the balance of the casting, there occurs, as illustrated in section $x_2$, an additional attenuation of the tensions, i.e. a contraction of the mold wall. Only upon the initiation of the pushing back of the mold, illustrated in section $x_3$, is the earlier tension pattern illustrated in zone $x_1$ reestablished.

The expansion or tension/stress measurement strip, as can be seen from the foregoing description, can be arranged in any zone of the mold wall in view of the fact that a breakthrough of the casting represents a particularly significant event by means of which the normal course in the change of stress is modified.

Figure 3:
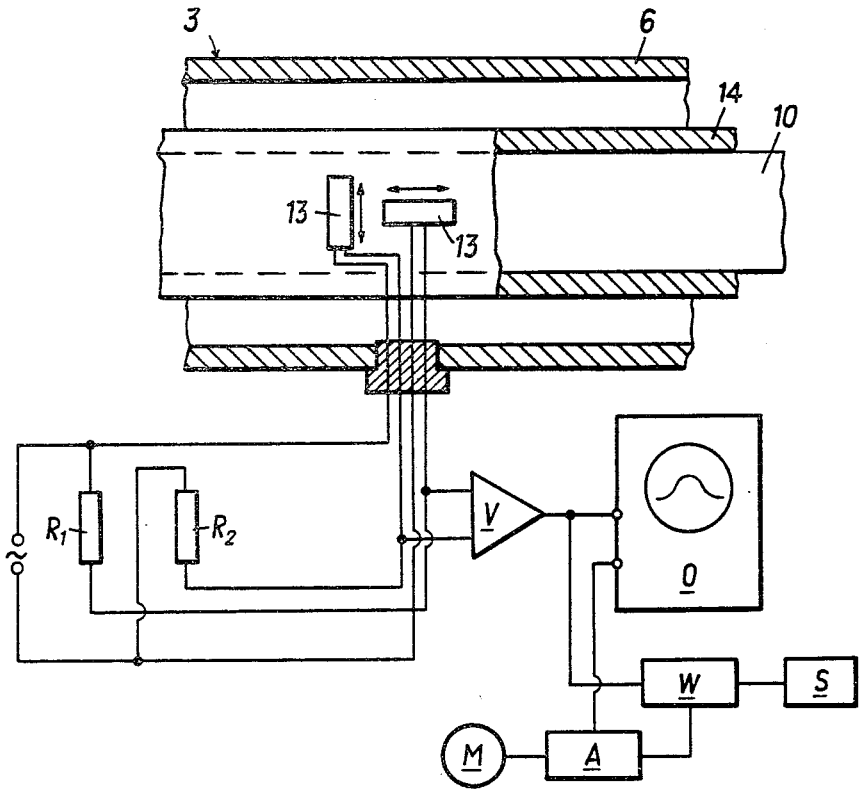
FIG. 3 is a block diagram of a circuit for recording signals from the measurement strips of FIG. 1.

In FIG. 3, the molding wall 14 of the mold is shown surrounded by the jacket 6 so as to form the intermediate space traversed by the cooling water. On this wall 14 there are arranged two expansion measurement strips 13, one of which is measuring the tension or expansion in the longitudinal direction and the other of which is making these measurements transverse to the casting withdrawal direction. The expansion measurement strips are connected with a power source via resistances R1 and R2 so as to form a bridge circuit. The voltage signal across the bridge is amplified in an amplifier V and is represented on the oscillograph O. The oscillograph has another input for control pulses from a drive control A. The pulses from the amplifier also proceed to a wave analyzer W. Whenever the wave analyzer detects that the signal is exceeding or falling below a threshold value, i.e. that the voltage across the bridge is changing beyond permissible limits because the resistance of the measurement strip is being upset by excessive forces in the mold wall, the analyzer actuates an acoustic signal transmitter S. In addition a signal is transmitted from the analyzer to the drive control A. The signal to the drive control will cause casting withdrawal motor M to drive roller 9 so as to push back the casting by less than the length of a step.

While the invention has been particularly shown and described with reference to a preferred embodiment thereof, it will be understood by those skilled in the art that various changes in form and details may be made therein without departing from the spirit and scope of the invention.

We claim:

1. A process for the control of the withdrawal of a casting from a cooled, horizontal, continuous casting mold composed of a material of elevated heat conductivity, which includes the steps of delivering metallic melt to the mold discontinuously, withdrawing the casting from the mold in a series of steps following formation of a casting skin, and, after each withdrawal step, pushing the casting back by a partial step, wherein the improvement comprises the steps of measuring the expansion or contraction of a wall of the mold in contact with the casting skin and controlling the withdrawal of the casting in response to the measured expansion or contraction.

2. A process according to claim 1, characterized in that the withdrawal of the casting is controlled in response to the expansion or contraction of the wall of the mold that is alternately in contact with the metallic melt and the casting skin.

3. A process according to claim 2, wherein the mold is cooled by the flow of cooling medium in a chamber adjacent the mold wall that contacts the metallic melt, characterized in that the expansion or contraction is sensed in the chamber traversed by the cooling medium.

4. A process according to claims 1, 2 or 3, characterized in that, in the event of a permanent expansion or contraction of the mold, the casting is pushed back by less than the length of a withdrawal step.

5. A process according to claim 3 characterized in that the pushing back of the casting is controlled in response to the expansion or contraction sensed.

6. A process according to claim 3 characterized in that the expansion or contraction is sensed via a measurement means for producing an electrical signal in response thereto.

7. A process according to claim 6 wherein said measurement means includes an expansion measurement strip.

8. A process according to claim 6 wherein said measurement means includes a pressure-sensitive quartz crystal.

9. A process according to claims 6, 7 or 8 wherein said electrical signal is compared to a reference and the withdrawal of a casting is controlled in response to said comparison.

10. A process according to claim 9 wherein said comparison is performed in a bridge circuit.

* * * * *